US008864446B2

(12) United States Patent
Singh et al.

(10) Patent No.: US 8,864,446 B2
(45) Date of Patent: Oct. 21, 2014

(54) WEAR PIN GAP CLOSURE DETECTION SYSTEM FOR GAS TURBINE ENGINE

(75) Inventors: Ram Bahadur Singh, Rajasthan (IN); David L. Wasdell, Winter Park, FL (US); Keith A Miller, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 749 days.

(21) Appl. No.: 13/113,351

(22) Filed: May 23, 2011

(65) Prior Publication Data

US 2012/0301276 A1 Nov. 29, 2012

(51) Int. Cl.

| | |
|---|---|
| ***F01D 25/00*** | (2006.01) |
| ***F04D 27/00*** | (2006.01) |
| ***F01D 11/00*** | (2006.01) |
| ***F01D 21/04*** | (2006.01) |

(52) U.S. Cl.

CPC ..... *F01D 11/001* (2013.01); *F05D 2260/80* (2013.01); *F05D 2260/36* (2013.01); *F05D 2260/30* (2013.01); *F04D 27/008* (2013.01); *F05D 2250/32* (2013.01); *F05D 2240/55* (2013.01); *F01D 21/04* (2013.01)

USPC ..... 415/118; 116/208

(58) Field of Classification Search

CPC ..... F01D 11/001; F01D 21/04; F04D 27/008; F05D 2240/55; F05D 2260/30; F05D 2260/36; F05D 2260/80; F05D 2250/32

USPC ..... 415/118, 9, 173.1, 173.4, 173.7, 174.4; 116/208, 212; 277/317, 321

See application file for complete search history.

(56) References Cited

U.S. PATENT DOCUMENTS

| | | | | |
|---|---|---|---|---|
| 1,326,651 | A | 12/1919 | Doran | |
| 3,829,233 | A * | 8/1974 | Scalzo et al. | 415/110 |
| 5,211,541 | A * | 5/1993 | Fledderjohn et al. | 416/198 A |
| 5,639,212 | A | 6/1997 | Schaefer et al. | |
| 7,207,768 | B2 * | 4/2007 | Gordon et al. | 415/118 |
| 7,889,119 | B2 | 2/2011 | Evers et al. | |
| 8,622,016 | B2 * | 1/2014 | Wiebe | 116/208 |
| 2006/0159547 | A1 | 7/2006 | Gordon et al. | |
| 2010/0066027 | A1 * | 3/2010 | Vasagar | 277/350 |

FOREIGN PATENT DOCUMENTS

| | | | |
|---|---|---|---|
| FR | 2765678 | A1 | 8/1999 |
| FR | 2929660 | A1 | 9/2009 |
| GB | 2425155 | A | 10/2006 |
| GB | 2438858 | A | 12/2007 |
| WO | 2010030448 | A1 | 3/2010 |

* cited by examiner

*Primary Examiner* — Ned Landrum
*Assistant Examiner* — Alexander White

(57) ABSTRACT

A wear indication system for use in turbine engines to measure the rate of gap closure between a seal holder and a rotor disk in a compressor blade assembly is disclosed. The wear indication system may include a support system capable of supporting a wear indicator formed from a relatively soft wear material without enabling the wear indicator to shift position or to fall out. One or more wear pins may be releasably attached to a compression plate with a seal holder. The seal holder may restrain the wear pin in position in an interference fit. During turbine engine operation, the wear pin is used to determine the rate of gap closing between a rotor disk and a seal holder precisely so that gas turbine engine repair can be scheduled and proper actions be taken to prevent rubbing between rotating and stationary parts of a compressor.

20 Claims, 4 Drawing Sheets

WEAR PIN GAP CLOSURE DETECTION SYSTEM FOR GAS TURBINE ENGINE

FIELD OF THE INVENTION

This invention is directed generally to gas turbine engines, and more particularly to wear indication systems for turbine systems in gas turbine engines.

BACKGROUND

Typically, gas turbine engines include a compressor for compressing air, a combustor for mixing the compressed air with fuel and igniting the mixture, and a turbine blade assembly for producing power. The compressor and turbine assemblies are formed of blades attached to a rotor interspersed with stationary stator vanes. The compressor and turbine assemblies include blades extending radially outward therefrom that are cooled with internal cooling systems and are collected into rows. Vanes extend radially inward and are collected into rows that are positioned between the rows of compressor and turbine assemblies. The stationary vane assemblies include seal arrangements with the rotor.

During operation, a seal holder attached to a stator vane tends to move upstream due to the pressure load acting in an upstream direction. The pressure load acts upstream because of a pressure difference between leading and trailing edges of the stator vane. During turbine engine operation, the upstream gap between the stator vane and the upstream rotor disk gradually reduces over time. As the stator vane moves toward the rotor disk, the gap reduces in size, and the seal holder will contact the rotor disk, which results in damage of rotor disk, the seal holder, and domestic damage of the compressor.

A wear pin has been used to determine the rate of closure of the gap between the stator vane and the rotor disk. The closure rate has been used to predict when the seal holder will hit the rotor disk. Such prediction has been used to schedule proper maintenance. The wear pin is usually formed from a soft material with low shear strength so that the wear pin wears without damaging the rotor disk upon which the wear pin contacts. The wear pin typically includes a threaded base and is screwed into place. Because of the low shear strength, the threads of the wear pin often shear off and allow the wear pin to become dislodged. As such, the wear pin becomes ineffective at predicting the gap closure rate. Thus, a need exists for a more robust mounting system for a wear pin.

SUMMARY OF THE INVENTION

This invention relates to a wear indication system for use in turbine engines to measure the rate of gap closure between a seal holder and a rotor disk in a compressor blade assembly. The wear indication system may include a support system capable of supporting a wear indicator formed from a relatively soft wear material without enabling the wear indicator, which may be, but is not limited to being, a wear pin, to shift position or to fall out. One or more wear pins may be releasably attached to a compression plate with a seal holder. The seal holder may restrain the wear pin in position in an interference fit. During turbine engine operation, the wear pin may be used to determine the rate of gap closing between a rotor disk and a seal holder precisely so that gas turbine engine repair can be scheduled and proper actions be taken to prevent rubbing between rotating components and stationary components of a compressor.

The wear indication system may include at least one compression plate that is generally elongated with at least one cavity having an opening in a first side surface. The compression plate may form a base for the wear indication system. At least one wear pin may be positioned partially in the at least one cavity such that a wear surface on the at least one wear pin is positioned radially outward from the at least one compression plate. The at least one wear pin may include a securing ring having the securing surface on one side that is adjacent and generally orthogonal to another outer side surface of the at least one wear pin. The securing ring may also include an outer surface that is generally opposite to the securing surface. The at least one wear pin may be formed from a plurality of rings positioned such that the smallest ring includes the wear surface, and the rings may increase in diameter moving towards the securing ring. The plurality of rings that form the at least one wear pin may include four rings in addition to the securing ring. An outer surface of the securing ring may have an outer diameter that is slightly larger than a diameter of the cavity in the compression plate such that an interference fit is formed when the securing ring of the wear pin is installed in the compression plate.

The wear indication system may include a seal holder releasably attached to the compression plate and having at least one orifice through which the wear pin extends. The orifice may be configured such that at least a portion of the seal holder contacts a securing surface on the wear pin that restricts the wear pin in the cavity. The seal holder may be attached to the compression plate via at least one screw with a head positioned on a surface of the compression plate opposite a side from which the at least one wear pin extends. The screw may be held in position with a tack weld to prevent accidental loosening of the screw and detachment of the seal holder.

The wear indication system may include a rotation prevention system to prevent the wear pin from rotating within the cavity. In at least one embodiment, the at least one cavity may include a keyway and the at least one wear pin may include at least one keyway configured to mesh with the at least one cavity to prevent the at least one wear pin from rotating after installation. The key may be formed from one or more flat surfaces on a curved side surface of the cavity. In another embodiment, the keyway may be formed from two flat surfaces opposed to each other on a curved side surface. In another embodiment, the cavity may include a keyway, and the wear pin may include at least one keyway configured to mesh with the keyway to prevent the wear pin from rotating after installation.

An advantage of this invention is that wear pin is kept in proper position without enabling the pin to be tilted and wear incorrectly.

Another advantage of this invention is that the configuration of the seal holder, compression plate and wear pin prevent the wear pin from falling into the flow path and damaging downstream turbine blades.

Yet another advantage of this invention is that the wear pin may be formed from a material having a dissimilar coefficient of thermal expansion from other components forming the wear indication system.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
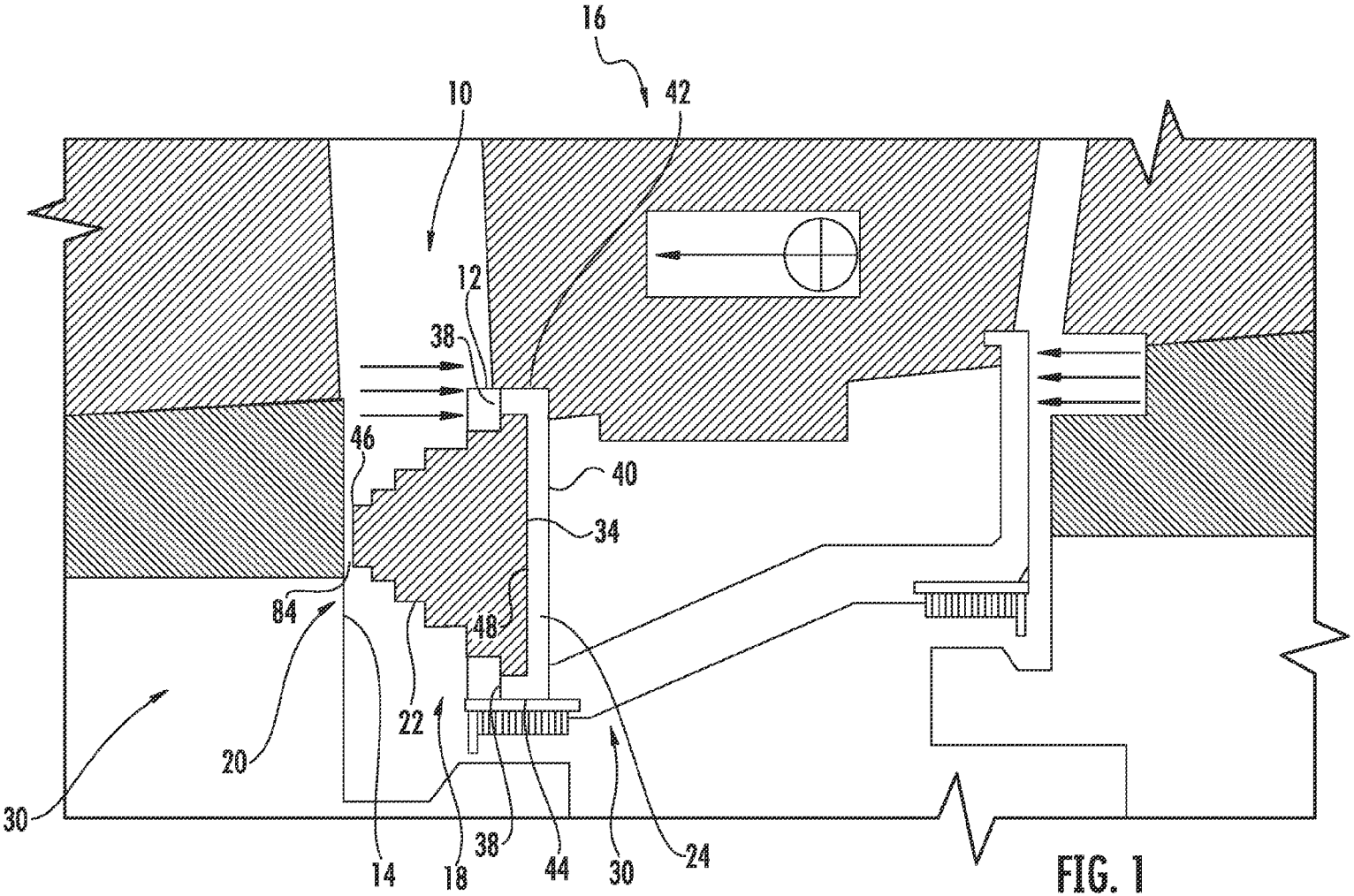
FIG. 1 is a partial side view of a turbine engine with a wear indication system attached in close proximity to a rotor disc.

As shown in FIGS. 1-5, this invention is directed to a wear indication system 10 for use in turbine engines to measure the rate of gap closure between a seal holder 12 and a rotor disk 14 in a compressor blade assembly 16. The wear indication system 10 may include a support system 18 capable of supporting a wear indicator 20 formed from a relatively soft wear material without enabling the wear indicator 20, which may be, but is not limited to being, a wear pin 22, to shift position or to fall out. One or more wear pins 22 may be releasably attached to a compression plate 24 with a seal holder 12. The seal holder 12 may restrain the wear pin 22 in position in an interference fit. During turbine engine operation, the wear pin 22 may be used to determine the rate of gap closing between the rotor disk 14 and a seal holder 12 precisely so that gas turbine engine repair can be scheduled and proper actions be taken to prevent rubbing between rotating components 30 and stationary components 32 of a compressor.

Figure 2:
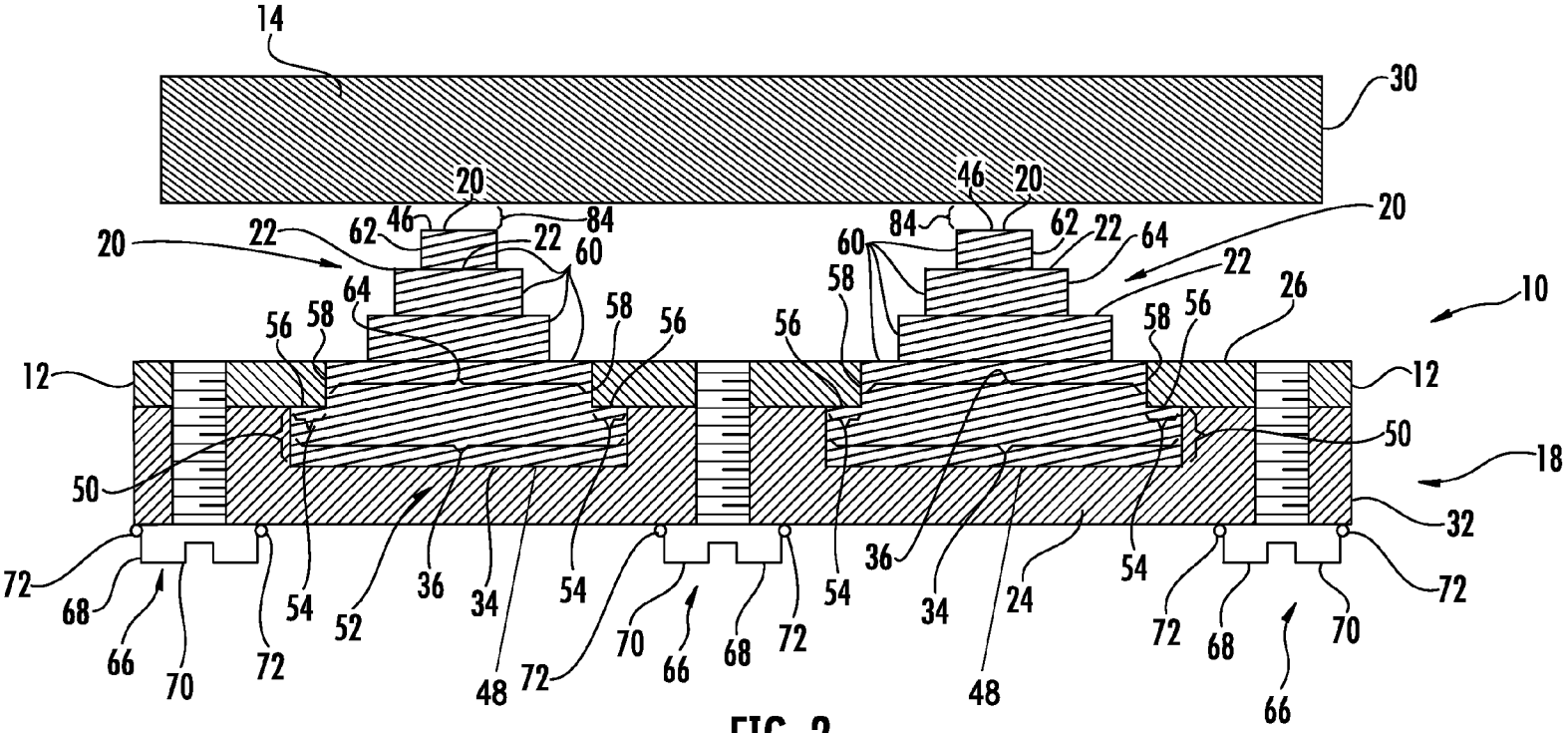
FIG. 2 is a detailed view of the wear indication system.
Figure 3:
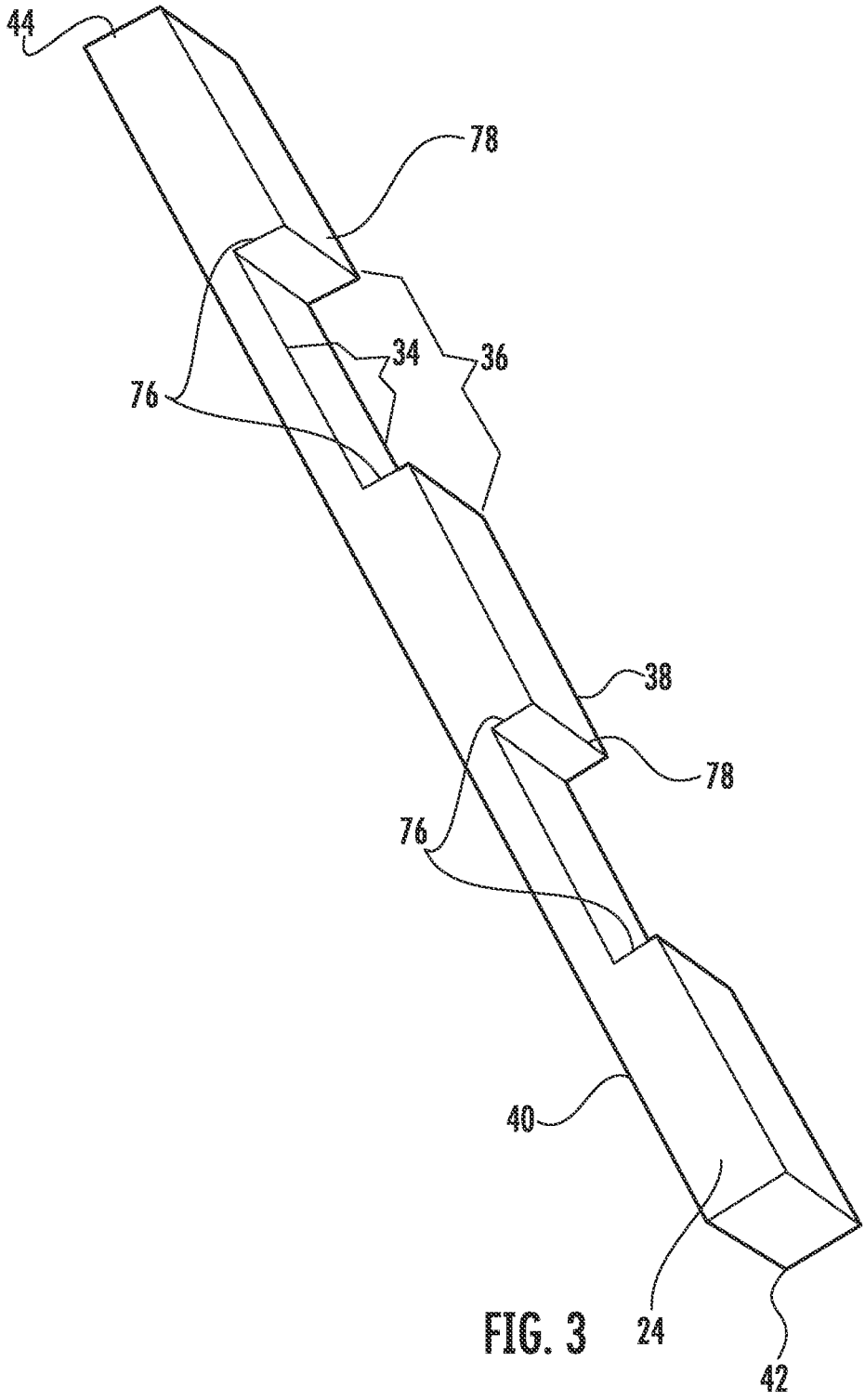
FIG. 3 is a perspective view of a compression plate of the wear indication system.

As shown in FIGS. 2 and 3, the compression plate 24 may be formed from a generally elongated piece of one or more materials. The compression plate may have first and second side surfaces 38, 40 that face opposite directions and are larger than first and second end surfaces 42, 44. The compression plate 24 may have one or more cavities 34 that are configured to contain at least a portion of a wear pin 22. The cavity 34 may be configured such that an opening 36 exists on one side of the compression plate 24. In at least one embodiment having a plurality of cavities 34, the openings 36 for each opening 36 may be on the same side of the compression plate 24. The opening 36 may extend into but not through the compression plate 24. The compression plate 24 may be formed from any appropriate material having sufficient strength to support the wear pin 22 in the turbine engine during turbine engine operation.

Figure 4:
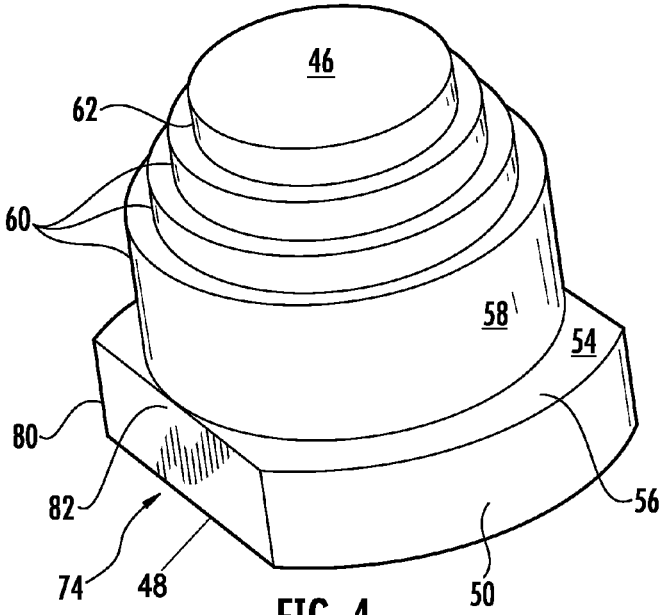
FIG. 4 is a perspective view of a wear pin of the wear indication system.
Figure 5:
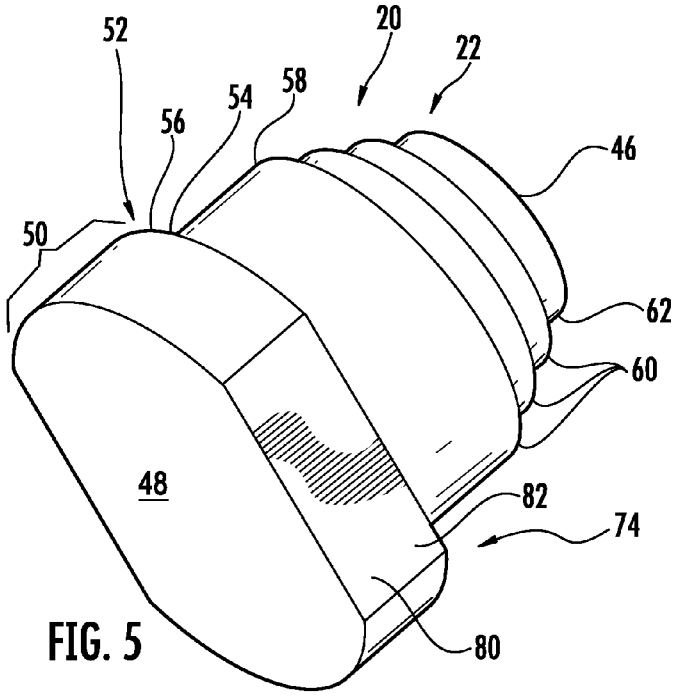
FIG. 5 is an alternative perspective view of the wear pin disclosed in FIG. 3.

The wear pin 22 may be configured to fit at least partially within the cavity 34. As shown in FIGS. 2, 4 and 5, the wear pin 22 may include a wear surface 46 positioned radially outward from an attachment surface 48 that contacts an inner surface of the cavity 34 in the compression plate 24. The wear surface 46 may be configured to contact an adjacent rotating component 30 to gauge the distance of the gap between seal holder 12 and the rotating component 30, which may be the rotor disk 14. The wear pin 22 may be formed from relatively soft materials with relatively low shear strength such that the wear pin 22 wears without damaging the component with which the wear pin 22 is in contact. The wear pin 22 may be formed from a material having a dissimilar coefficient of thermal expansion from other components of the wear indication system 10. The wear pin 22 may include a securing ring 50 positioned at a base 52 of the wear pin 22. The wear pin 22 may have a securing surface 54 on one side 56 that is adjacent and generally orthogonal to another outer side surface 58 of the wear pin 22, and the attachment surface 48 of the securing ring 50 may be generally opposite to the securing surface 54. The wear pin 22 may be positioned partially in the cavity 34 such that a wear surface 46 on the wear pin 22 is positioned radially outward from the compression plate 24 and the attachment surface 48.

In at least one embodiment, the wear pin 22 may be formed from a plurality of rings 60 positioned such that the smallest ring 62 includes the wear surface 46, and the rings 60 increase in diameter moving towards the securing ring 50. In at least one embodiment, the plurality of rings 60 forming the wear pin 22 may be four rings 60 in addition to the securing ring 50. The securing ring 50 may have an outer diameter that is slightly larger than a diameter of the cavity 34 in the compression plate 24 such that an interference fit is formed when the securing ring 50 of the wear pin 22 is installed in the compression plate 24.

The seal holder 12 may be releasably attached to the compression plate 24 and may have one or more orifices 36 through which the wear pin 22 extends. The orifice 36 may be configured such that at least a portion of the seal holder 12 may contact the securing surface 54 on the wear pin 22 that restricts the wear pin 22 in the cavity 34. The seal holder 12 may be attached to the compression plate 24 via a releasable attachment device 66. The releasable attachment device 66 may be, but is not limited to being, one or more screws 68 with a head 70 positioned on a second side surface 40 of the compression plate 24 opposite the first side surface 38 from which the wear pin 22 extends. The screws 68 may be held in position with a retention device 72, such as, but not limited to, a tack weld on each screw 68.

As shown in FIGS. 4 and 5, the wear pin 22 may be constructed such that the wear pin 22 is prevented from rotating in the cavity 34. In at least one embodiment, the wear indication system 10 may include a rotation prevention system 74 that prevents the wear pin 22 from rotating during use. The rotation prevention system 74 may be formed from one or more keyways 76 extending radially inward from the surface 78 forming the cavity 34, and the wear pin 22 may include one or more key 80 configured to mesh with the keyway 76 in the cavity 34 to prevent the wear pin 22 from rotating after installation. The keyway 80 may be formed from one or more flat surfaces 82 on a curved side surface. In at least one embodiment, as shown in FIGS. 4 and 5, the keyway 80 may be formed from two flat surfaces 82 opposed to each other on the curved side surface. In another embodiment, the rotation prevention system 74 may be configured such that the cavity 34 includes one or more keyways 80 and the wear pin 22 includes one or more keyways 76 configured to mesh with the keyway 80 to prevent the wear pin 22 from rotating after installation.

The wear pin 22 may be placed in contact with the surface 78 defining the cavity 34. The seal holder 12 may be placed into contact with the securing surface 54 of the wear pin 22. The screws 68 may be inserted through the compression plate 24 and may be attached to the seal holder 12. The screws 68 may be tightened, thereby forcing the securing ring 50 of the wear pin 22 into the cavity 34 and securing the seal holder 12 against the compression plate 24. During assembly, a gap 84 distance of about 1 millimeter is kept between the seal holder 12 and the compression plate 24. During operation, as the gap 84 between the rotor disc 14 and the seal holder 12 is reduced, the wear pin 22 contacts the wear pin 22. Over time of turbine engine operation, the wear pin 22 is reduced. In addition, because the wear indication system 10 prevents the wear pin 22 from rotating and from moving relative to the compression plate 24, the wear pin 22 is not able to be worn along the neck of the wear pin 22 such that the wear surface 46 is generally nonorthogonal to a longitudinal axis of the wear pin 22.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A wear indication system for turbine assemblies of a as turbine engine, comprising:

at least one compression plate that is generally elongated with at least one cavity having an opening in a first side surface;

at least one wear pin positioned partially in the at least one cavity such that a wear surface on the at least one wear pin is positioned radially outward from the at least one compression plate;

a seal holder releasably attached to the at least one compression plate and having at least one orifice through which the at least one wear pin extends, wherein the at least one orifice is configured such that at least a portion of the seal holder contacts a securing surface on the at least one wear pin that restricts the at least one wear pin in the at least one cavity;

wherein the at least one wear pin includes a securing ring having the securing surface on one side that is adjacent and generally orthogonal to another outer side surface of the at least one wear pin, and the securing ring includes an outer surface that is generally opposite to the securing surface; and wherein the at least one wear pin is formed from a plurality of rings positioned such that the smallest ring includes the wear surface and the rings increase in diameter moving towards the securing ring.

2. The wear indication system of claim 1, wherein the plurality of rings forming the at least one wear pin comprises four rings in addition to the securing ring.

3. The wear indication system of claim 1, wherein an outer surface of the securing ring has an outer diameter that is slightly larger than a diameter of the at least one cavity in the at least one compression plate such that an interference fit is formed when the securing ring of the at least one wear pin is installed in the at least one compression plate.

4. The wear indication system of claim 1, wherein the at least one cavity includes a keyway and the at least one wear pin includes at least one key configured to mesh with the keyway to prevent the at least one wear pin from rotating after installation.

5. A wear indication system for turbine assemblies of a as turbine engine, comprising:

at least one compression plate that is generally elongated with at least one cavity having an opening in a first side surface;

at least one wear pin positioned partially in the at least one cavity such that a wear surface on the at least one wear pin is positioned radially outward from the at least one compression plate;

a seal holder releasably attached to the at least one compression plate and having at least one orifice through which the at least one wear pin extends, wherein the at least one orifice is configured such that at least a portion of the seal holder contacts a securing surface on the at least one wear pin that restricts the at least one wear pin in the at least one cavity; and wherein the at least one cavity includes a key and the at least one wear pin includes at least one keyway configured to mesh with the at least one cavity to prevent the at least one wear pin from rotating after installation.

6. The wear indication system of claim 5, wherein the at least one keyway is formed from at least one flat surface on a curved side surface.

7. The wear indication system of claim 6, wherein the at least one keyway is formed from two flat surfaces opposed to each other on a curved side surface.

8. A wear indication system for turbine assemblies of a gas turbine engine, comprising:

at least one compression plate that is generally elongated with at least one cavity having an opening in a first side surface;

at least one wear pin positioned partially in the at least one cavity such that a wear surface on the at least one wear pin is positioned radially outward from the at least one compression plate;

a seal holder releasably attached to the at least one compression plate and having at least one orifice through which the at least one wear pin extends, wherein the at least one orifice is configured such that at least a portion of the seal holder contacts a securing surface on the at least one wear pin that restricts the at least one wear pin in the at least one cavity; and wherein the seal holder is attached to the at least one compression plate via at least one screw with a head positioned on a surface of the at least one compression plate opposite a side from which the at least one wear pin extends.

9. The wear indication system of claim 8, wherein the at least one screw is held in position with a tack weld.

10. The wear indication system of claim 8, wherein the at least one wear pin is formed from a plurality of rings positioned such that the smallest ring includes the wear surface and the rings increase in diameter moving towards the securing ring.

11. The wear indication system of claim 10, wherein the plurality of rings forming the at least one wear pin comprises four rings in addition to the securing ring.

12. The wear indication system of claim 8, further comprising a key and at least one keyway configured to prevent the at least one wear pin from rotating after installation.

13. The wear indication system of claim 8, wherein the at least one wear pin includes a securing ring having the securing surface on one side that is adjacent and generally orthogonal to another outer side surface of the at least one wear pin, and the securing ring includes an outer surface that is generally opposite to the securing surface.

14. A wear indication system for turbine assemblies of a gas turbine engine, comprising:

at least one compression plate that is generally elongated with at least one cavity having an opening in a first side surface;

at least one wear pin positioned partially in the at least one cavity such that a wear surface on the at least one wear pin is positioned radially outward from the at least one compression plate;

a seal holder releasably attached to the at least one compression plate and having at least one orifice through which the at least one wear pin extends, wherein the at least one orifice is configured such that at least a portion of the seal holder contacts a securing surface on the at least one wear pin that restricts the at least one wear pin in the at least one cavity;

wherein the at least one wear pin includes a securing ring having an outer contact surface at a first end of the at least one wear pin and having the securing surface on a side that faces an opposite direction from the outer contact surface and that is adjacent and generally orthogonal to an outer side surface of the at least one wear pin; and wherein an outer surface of the securing ring has an outer diameter that is slightly larger than a diameter of the at least one cavity in the at least one compression plate such that an interference fit is formed when the securing ring of the at least one wear pin is installed in the at least one compression plate.

15. The wear indication system of claim 14, further comprising a key and at least one keyway configured to prevent the at least one wear pin from rotating after installation.

16. The wear indication system of claim 15, wherein the at least one keyway is formed from two flat surfaces on the securing ring opposed to each other on a curved side surface.

17. A wear indication system for turbine assemblies of a gas turbine engine, comprising:

at least one compression plate that is generally elongated with at least one cavity having an opening in a first side surface;

at least one wear pin positioned partially in the at least one cavity such that a wear surface on the at least one wear pin is positioned radially outward from the at least one compression plate;

a seal holder releasably attached to the at least one compression plate and having at least one orifice through which the at least one wear pin extends, wherein the at least one orifice is configured such that at least a portion of the seal holder contacts a securing surface on the at least one wear pin that restricts the at least one wear pin in the at least one cavity;

wherein the at least one wear pin includes a securing ring having an outer contact surface at a first end of the at least one wear pin and having the securing surface on a side that faces an opposite direction from the outer contact surface and that is adjacent and generally orthogonal to an outer side surface of the at least one wear pin;

wherein the at least one wear pin is formed from a plurality of rings positioned such that the smallest ring includes the wear surface and the rings increase in diameter moving towards the securing ring;

wherein an outer surface of the securing ring has an outer diameter that is slightly larger than a diameter of the at least one cavity in the at least one compression plate such that an interference fit is formed when the securing ring of the at least one wear pin is installed in the at least one compression plate; and wherein the at least one cavity includes a key and the at least one wear pin includes at least one keyway configured to mesh with the at least one cavity to prevent the at least one wear pin from rotating after installation.

18. The wear indication system of claim 17, wherein the plurality of rings forming the at least one wear pin comprises four rings in addition to the securing ring.

19. The wear indication system of claim 17, wherein the at least one keyway is formed from two flat surfaces opposed to each other on a curved side surface.

20. The wear indication system of claim 17, wherein the seal holder is attached to the compression plate via at least one screw with a head positioned on a surface of the compression plate opposite a side from which the at least one wear pin extends and wherein the at least one screw is held in position with a tack weld.

* * * * *